US005964307A

United States Patent [19]

Wenzel

[11] Patent Number: 5,964,307

[45] Date of Patent: Oct. 12, 1999

[54] SHOCK TOOL FOR USE IN DIRECTIONAL DRILLING

[75] Inventor: William Ray Wenzel, Edmonton, Canada

[73] Assignee: Wenzel Downhole Tools Ltd., Edmonton, Canada

[21] Appl. No.: 08/879,766

[22] Filed: Jun. 20, 1997

[30] Foreign Application Priority Data

Sep. 3, 1996 [CA] Canada ..... 2184665

[51] Int. Cl.[6] ..... E21B 17/07

[52] U.S. Cl. ..... 175/321; 175/92

[58] Field of Search ..... 175/321, 320, 175/92, 107

[56] References Cited

U.S. PATENT DOCUMENTS 4,194,582 3/1980 Ostertag ..... 175/321

5,133,419 7/1992 Barrington ..... 175/321

*Primary Examiner*—Tamara Graysay

*Assistant Examiner*—Chi Kamg

*Attorney, Agent, or Firm*—Anthony R. Lambert

[57] ABSTRACT

A shock tool includes a first tubular member, a second tubular member and a third tubular member. The first tubular member has an interior bore that extends between a first end and a second end. The second tubular member has an interior bore that extends between a first end and an attachment end. The second tubular member is rotatably supported by both radial and thrust bearings within the interior bore of the first tubular member with the attachment end protruding from the second end of the first tubular member. The third tubular member has an interior bore that extends between a connection end and a second end. The second end of the third tubular member being telescopically received within the interior bore at the first end of the second tubular member with the connection end protruding. The third tubular member is capable of limited reciprocal movement relative to the second tubular member. Shock absorbing medium is disposed between the third tubular member and the second tubular member. This shock tool has the ability to bear radial and thrust loads, in addition to shock loading.

12 Claims, 4 Drawing Sheets

SHOCK TOOL FOR USE IN DIRECTIONAL DRILLING

FIELD OF THE INVENTION

The present invention relates to a shock tool for use in directional drilling.

BACKGROUND OF THE INVENTION

In directional drilling, an oil and gas well is drilled to a selected depth using a drilling motor assembly at the end of flexible drill string. Once the selected depth is achieved the drilling motor assembly is then diverted at an angle across an oil or gas bearing formation until the drilling motor assembly is in a horizontal orientation. The drilling motor assembly generally consists of a motor unit, a drive linkage, a bearing assembly and a drill bit. The motor unit includes a drilling fluid activated rotor that moves in an eccentric fashion within a stator housing. The drive linkage unit translates the eccentric rotation of the rotor into a rotational movement needed to turn the drill bit, through use of a drive shaft with a universal joint attachment. The drill bit is indirectly mounted to one end of the drive linkage via a bearing assembly. The bearing assembly has thrust and radial bearings to withstand the radial and thrust loading that the drill bit is subjected to when drilling through earth formations.

For years shock tools have been used when drilling oil and gas wells to lessen shock loading and thereby prolong the useful life of the drill bit. With directional drilling shock tools are generally not used, as they add to the length of the drilling motor assembly and limit the angle at which the drilling motor can be steered from a vertical drilling mode to a horizontal drilling mode.

SUMMARY OF THE INVENTION

What is required is a shock tool that is better suited to the needs of directional drilling.

According to the present invention there is provided a shock tool which includes a first tubular member, a second tubular member and a third tubular member. The first tubular member has an interior bore that extends between a first end and a second end. The second tubular member has an interior bore that extends between a first end and an attachment end. The second tubular member is rotatably supported by both radial and thrust bearings within the interior bore of the first tubular member with the attachment end protruding from the second end of the first tubular member. The third tubular member has an interior bore that extends between a connection end and a second end. The second end of the third tubular member being telescopically received within the interior bore at the first end of the second tubular member with the connection end protruding. The third tubular member is capable of limited reciprocal movement relative to the second tubular member. Shock absorbing means are disposed between the third tubular member and the second tubular member.

The shock tool, as described above, has the ability to withstand radial loading, axial loading and shock loading. It is, in essence, a bearing assembly/shock tool combination. When this shock tool is coupled with a downhole power section of a drilling motor, a bearing assembly is not required.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
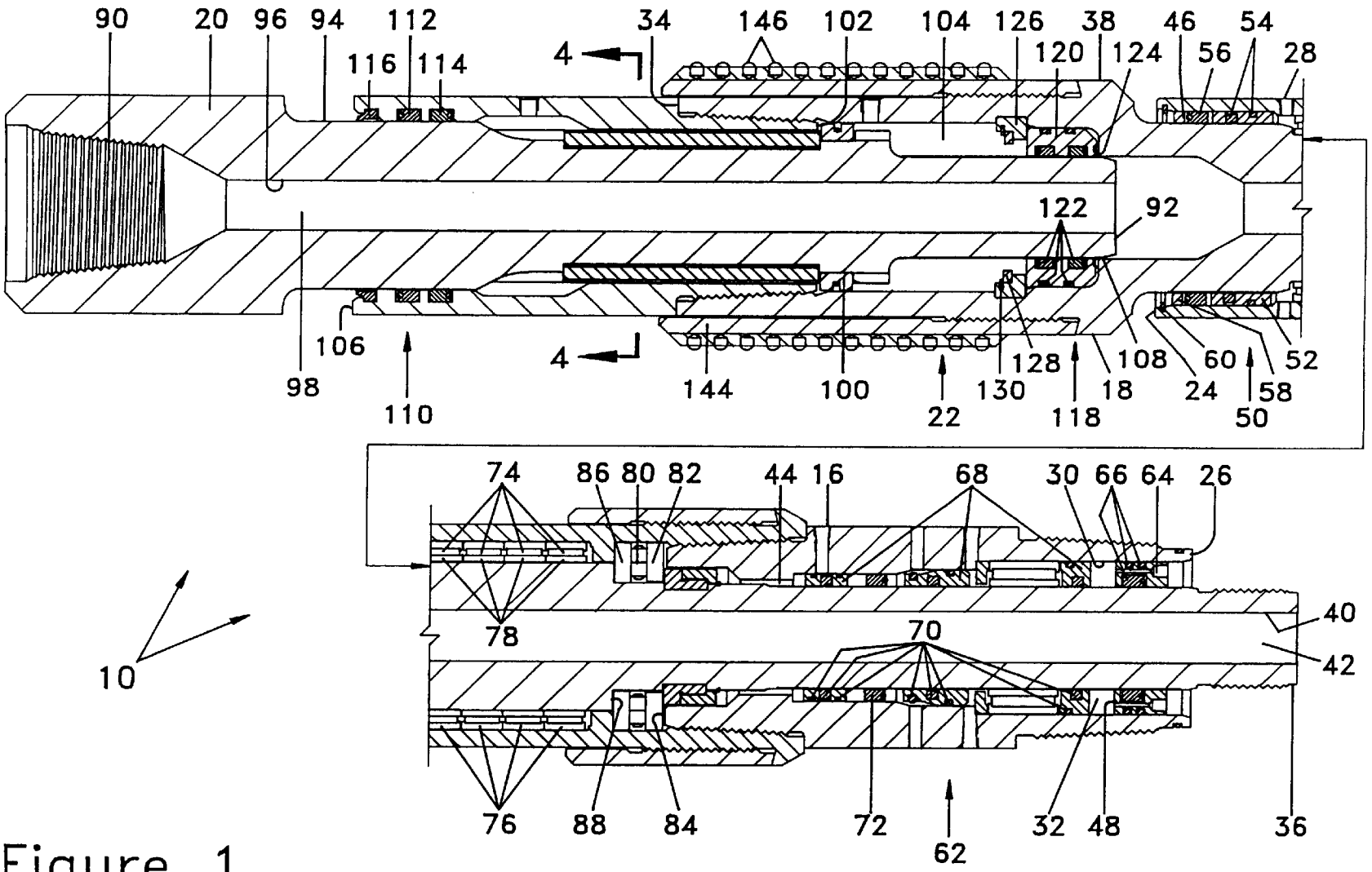
FIG. 1 is a side elevation view, in section of a first embodiment of a shock tool constructed in accordance with the teachings of the present invention.
Figure 2:
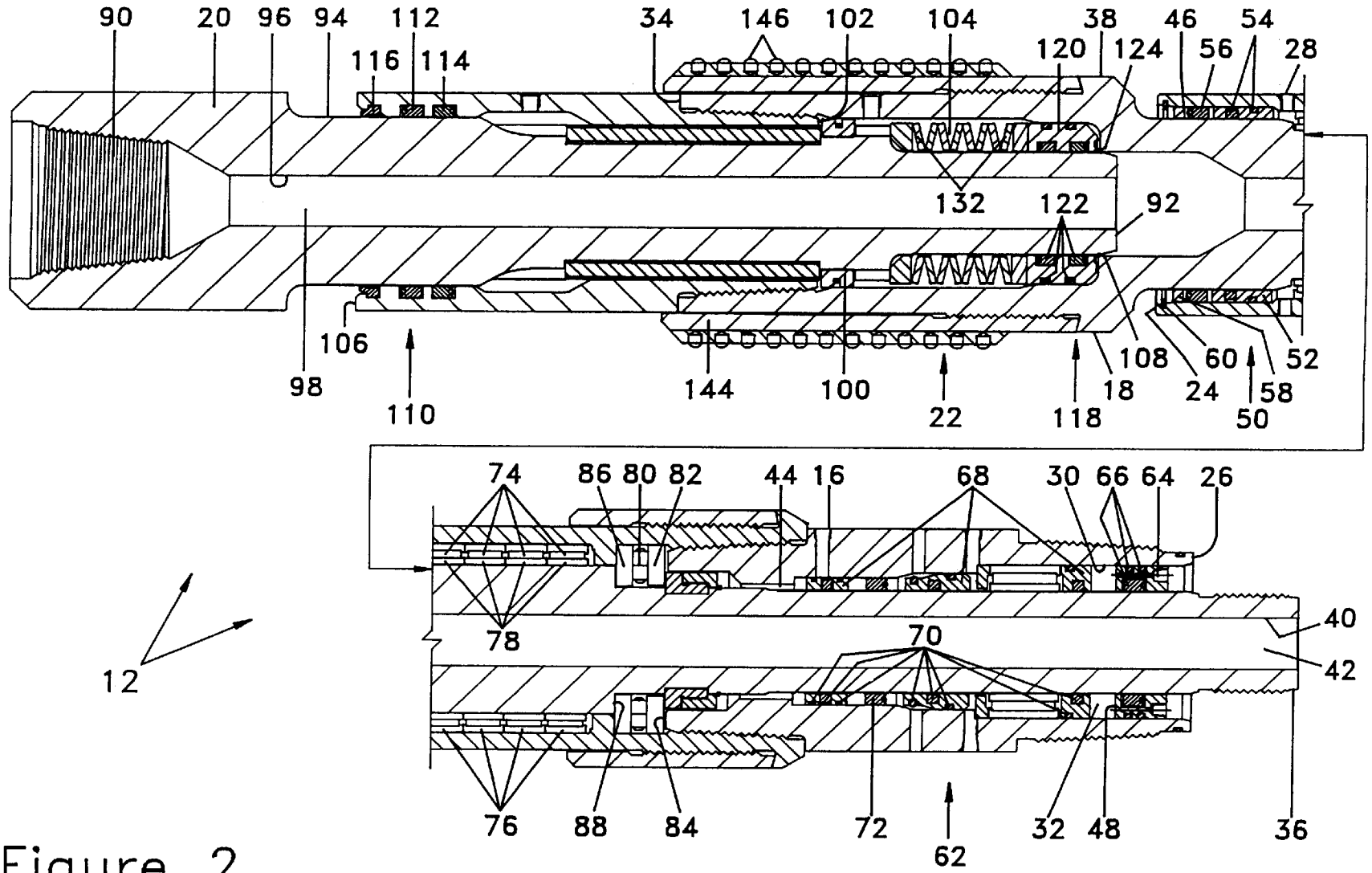
FIG. 2 is a side elevation view, in section of a second embodiment of a shock tool constructed in accordance with the teachings of the present invention.
Figure 3:
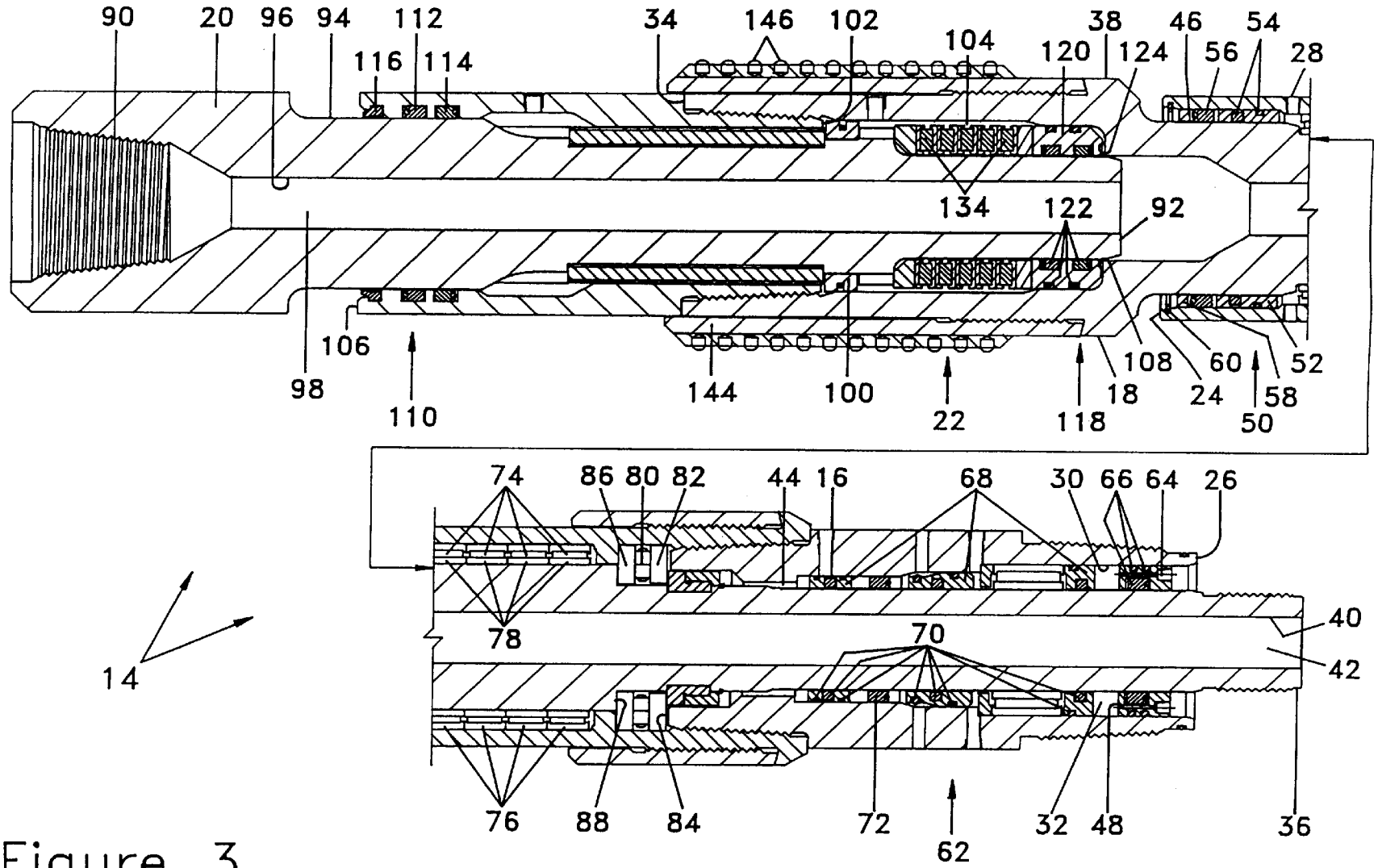
FIG. 3 is a side elevation view, in section of a third embodiment of a shock tool constructed in accordance with the teachings of the present invention.

The preferred embodiments of a shock tool will now be described with reference to FIGS. 1 through 4. FIG. 1 illustrates a first embodiment generally identified by reference numeral 10. FIG. 2 illustrates a second embodiment generally identified by reference numeral 12. FIG. 3 illustrates a third embodiment generally identified by reference numeral 14. The first, second and third embodiments are identical in most respects, in the description which follows identical elements will be identified by identical reference numerals.

Referring to FIGS. 1 through 3, each of the embodiments of shock tool 10, 12, and 14 includes a first tubular member 16, a second tubular member 18, a third tubular member 20, and shock absorbing means 22. First tubular member 16, second tubular member 18 and third tubular member 20 of each embodiment are identical. The embodiments only differ in respect to shock absorbing means 22, as will hereinafter be described. First tubular member 16 has a first end 24, a second end 26, an exterior surface 28, and an interior surface 30. Interior surface 30 serves to define an interior bore 32 that extends between first end 24 and second end 26. Second tubular member 18 is of greater length than first tubular member 16. Second tubular member 18 has a first end 34, a drive linkage attachment end 36, an exterior surface 38, and an interior surface 40. Interior surface 40 serves to define an interior bore 42 that extends between first end 34 and drive linkage attachment end 36. Second tubular member 18 extends through interior bore 32 of first tubular member 16. First end 34 of second tubular member 18 extends past first end 24 of first tubular member 16. Drive linkage attachment end 36 of second tubular member 18 extends past second end 26 of first tubular member 16. Second tubular member 18 is rotatable relative to first tubular member 16. A lubricant retaining bearing chamber 44 is positioned between interior surface 30 of first tubular member 16 and exterior surface 38 of second tubular member 18. Lubricant retaining bearing chamber 44 has a first end 46 and a second end 48. A first sealing assembly, generally indicated by reference numeral 50 is positioned at first end 46 of lubricant retaining bearing chamber 44. First sealing assembly 50 includes a pressure responsive annular piston 52 having elastomer sealing elements 54, a primary elastomer seal 56, a sealing ring 58 and a locking ring 60. A second sealing assembly, generally indicated by reference numeral 62, is positioned at second end 48 of lubricant retaining bearing chamber 44. Second sealing assembly 62 includes a pressure responsive primary annular piston 64 having elastomer sealing elements 66, and a plurality of pressure responsive secondary annular piston elements 68 also having elastomer sealing elements 70. An primary elastomer seal 72 is positioned intermediate two of the secondary annular piston elements 68. Radial bearings 74 are positioned in lubricant retaining bearing chamber 44 spaced from each of first end 46 and second end 48. Bearings 74 have a first race 76 engaging interior surface 30 of first tubular member 16 and a second race 78 engaging exterior surface 38 of second tubular member 18. A thrust bearing 80 is positioned in an intermediate position in lubricant retaining bearing chamber 44. Thrust bearing 80 has a first race 82 engaging a first shoulder 84 protruding from interior surface 30 of first tubular member 16 and a second race 86 engaging a second shoulder 88 protruding from exterior surface 38 of second tubular member 18. Third tubular member 20 has a bit connection end 90, a second end 92, an exterior surface 94 and an interior surface 96. Interior surface 96 serves to define an interior bore 98 that extends between bit connection end 90 and second end 92. Second end 92 of third tubular member 20 is telescopically received in interior bore 42 at first end 34 of second tubular member 18. Third tubular member 20 is capable of limited reciprocal movement relative to second tubular member 18, as means are provided to limit such movement in order to prevent withdrawal of third tubular member 20 from first end 34 of second tubular member 18. In the illustrated embodiments such stop means includes an annular member 100 secured to exterior surface 94 of third tubular member 20. Annular member 100 engages an inwardly projecting shoulder 102 on interior surface 40 of second tubular member 18.

Shock absorbing means 22 will now be described. In first embodiment 10, illustrated in FIG. 1, the shock absorbing means includes an hydraulic dampening chamber 104 disposed between exterior surface 94 of third tubular member 20 and interior surface 40 of second tubular member 18. Hydraulic dampening chamber 104 has a first end 106 and a second end 108. A first sealing assembly 110 is positioned at first end 106. First sealing assembly 110 includes two back to back elastomer seals 112 and 114, and a wiper seal 116. A second sealing assembly 118 is positioned at second end 108. Second sealing assembly 118 includes an annular piston 120 that is secured in a fixed position to interior surface 40 of second tubular member 18. Annular piston 120 has a plurality of sealing elements 122. Annular piston 120 is held against a shoulder 124 by a split ring 126, secured by a lock ring 128 which, in turn, is retained by a snap ring 130. In second embodiment 12, illustrated in FIG. 2, the shock absorbing means includes springs and, in particular, belville style springs 132. In the third embodiment 14, as illustrated in FIG. 3, the shock absorbing means are urethane spring elements 134.

Figure 4:
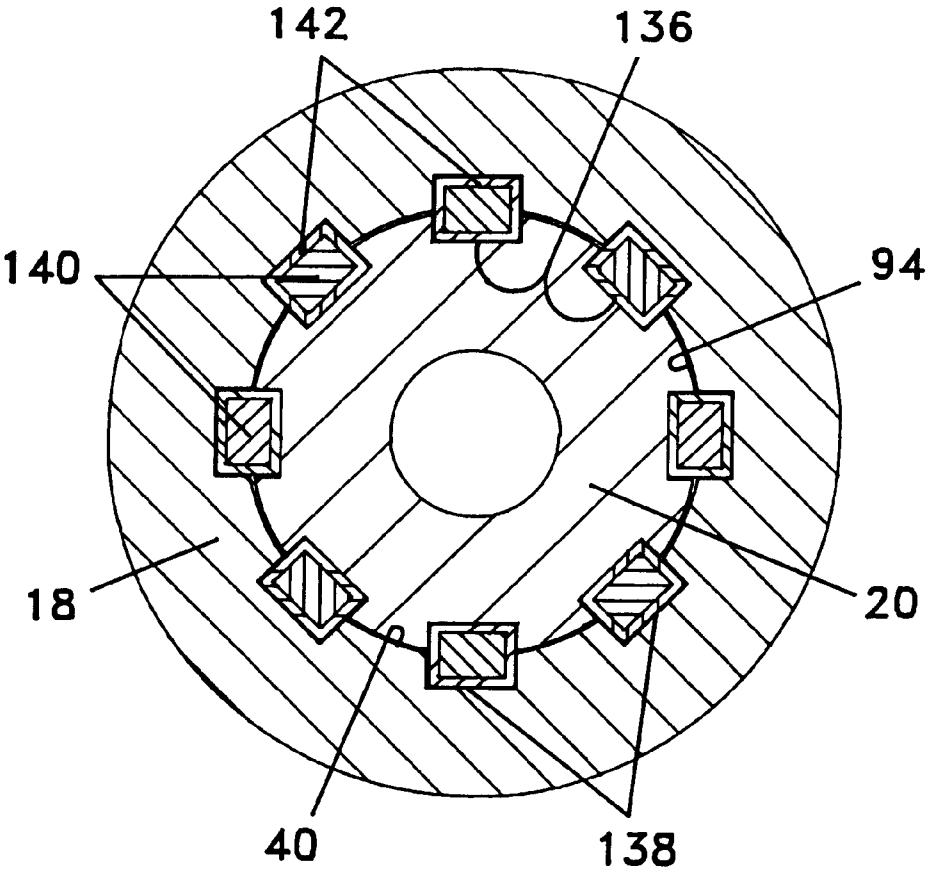
FIG. 4 is a transverse section view taken along section lines 4—4 of FIG. 1.

Referring to FIG. 4, a first group of spline grooves 136 are positioned in exterior surface 94 of third tubular member 20 and a second group of spline grooves 138 are positioned in interior surface 40 of second tubular member 18. Spline 140 extend between group of spline grooves 136 and second group of spline grooves 138. This rotatably couples third tubular member 20 to second tubular member 18. It is preferred that spline 140 have a urethane coating 142, as this provides some dampening of torsional shock loading.

Referring to FIGS. 1 through 3, an additional feature that can be added if desired for an intended application is a reamer/stabilizer sleeve 144. Reamer/stabilizer sleeve 144 engages exterior surface 38 of second tubular member 18. Reamer/stabilizer sleeve 144 has a raised profile consisting of a plurality of wear resistant buttons 146.

The use and operation of the shock tool will now be described with reference to FIGS. 1 through 4. Drive linkage connection end 36 is attached to a drive shaft (not shown) of a drilling motor assembly. Bit connection end 90 is attached to a drill bit (not shown). The drilling motor assembly imparts a rotational force to second tubular member 18. Second tubular member 18 is supported during such rotation by radial bearings 74. Third tubular member 20 rotates with second tubular member 18, due to the presence of spline 140. When the drill bit strikes a rock or in some other manner experiences a shock load, this shock load is absorbed by third tubular member 20 telescopically moving into interior bore 42 of second tubular member 18. This movement is dampened by fluids within hydraulic dampening chamber 104. In second embodiment 12 and third embodiment 14, the movement is also dampened by belville style springs 132 and urethane spring elements 134, respectively. In the event of a torsional load, this torsional load is dampened to some extent by urethane coating 142 on spline 140. Axial thrust loading is borne by thrust bearing 80.

It will be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. A shock tool, comprising:

a first tubular member having an interior bore that extends between a first end and a second end;

a second tubular member having an interior bore that extends between a first end and an attachment end, the second tubular member being rotatably supported by both radial and thrust bearings within the interior bore of the first tubular member with the attachment end protruding from the second end of the first tubular member;

a third tubular member having an interior bore that extends between a connection end and a second end, the second end of the third tubular member being telescopically received within the interior bore at the first end of the second tubular member with the connection end protruding, the third tubular member being rotatably coupled to the second tubular member and being capable of limited reciprocal movement relative to the second tubular member; and shock absorbing means disposed between the third tubular member and the second tubular member.

2. A shock tool, comprising:

a first tubular member having a first end, a second end, an exterior surface, and an interior surface defining an interior bore that extends between the first end and the second end;

a second tubular member of greater length than the first tubular member, the second tubular member having a first end, an attachment end, an exterior surface, and an interior surface defining an interior bore that extends between the first end and the attachment end, the second tubular member extending through the interior bore of the first tubular member with the first end of the second tubular member extending past the first end of the first tubular member and the attachment end of the second tubular member extending past the second end of the first tubular member, the second tubular member being rotatable relative to the first tubular member;

bearing means being disposed in a sealed lubricant retaining bearing chamber positioned between the interior surface of the first tubular member and the exterior surface of the second tubular member;

a third tubular member having a connection end, a second end and an interior bore that extends between the connection end and the second end, the second end of the third tubular member being telescopically received within the interior bore at the first end of the second tubular member, the third tubular member being rotatably coupled to the second tubular member and being capable of limited reciprocal movement relative to the second tubular member;

stop means being provided to limit reciprocal movement of the third tubular member and prevent withdrawal of the third tubular member from the first end of the second tubular member; and shock absorbing means being disposed between the third tubular member and the second tubular member whereby reciprocal movement of the third tubular member is dampened.

3. The shock tool as defined in claim 2, further comprising a reamer/stabilizer sleeve engaging the exterior surface of the second tubular member, the reamer/stabilizer sleeve having a raised profile.

4. A shock tool, comprising:

a first tubular member having a first end, a second end, an exterior surface, and an interior surface defining an interior bore that extends between the first end and the second end;

a second tubular member of greater length than the first tubular member, the second tubular member having a first end, a drive linkage attachment end, an exterior surface, and an interior surface defining an interior bore that extends between the first end and the drive linkage attachment end, the second tubular member extending through the interior bore of the first tubular member with the first end of the second tubular member extending past the first end of the first tubular member and the drive linkage attachment end of the second tubular member extending past the second end of the first tubular member, the second tubular member being rotatable relative to the first tubular member;

a lubricant retaining bearing chamber positioned between the interior surface of the first tubular member and the exterior surface of the second tubular member, the lubricant retaining bearing chamber having a first end and a second end;

first sealing means positioned at the first end of the lubricant retaining bearing chamber;

second sealing means positioned at the second end of the lubricant retaining bearing chamber;

a plurality of radial bearings positioned in the lubricant retaining bearing chamber, the bearings having a first race engaging the interior surface of the first tubular member and a second race engaging the exterior surface of the second tubular member;

at least one thrust bearing positioned in the lubricant retaining bearing chamber, the at least one thrust bearing having a first race engaging a first shoulder protruding the interior surface of the first tubular member and a second race engaging a second shoulder protruding from the exterior surface of the second tubular member;

a third tubular member having a bit connection end, a second end, an exterior surface and an interior surface defining an interior bore that extends between the bit connection end and the second end, the second end of the third tubular member being telescopically received within the interior bore at the first end of the second tubular member, the third tubular member being rotatably coupled to the second tubular member and being capable of limited reciprocal movement relative to the second tubular member;

stop means being provided to limit reciprocal movement of the third tubular member and prevent withdrawal of the third tubular member from the first end of the second tubular member; and shock absorbing means being disposed between the third tubular member and the second tubular member whereby reciprocal movement of the third tubular member is dampened.

5. The shock tool as defined in claim 4, wherein the stop means includes an annular member secured to the exterior surface of the third tubular member, that engages an inwardly projecting shoulder on the interior surface of the second tubular member.

6. The shock tool as defined in claim 4, wherein the shock absorbing means includes an hydraulic dampening chamber disposed between the exterior surface of the third tubular member and the interior surface of the second tubular member.

7. The shock tool as defined in claim 4, wherein the shock absorbing means includes springs.

8. The shock tool as defined in claim 7, wherein the springs are belville style springs.

9. The shock tool as defined in claim 7, wherein the springs are urethane spring elements.

10. The shock tool as defined in claim 4, wherein a first group of spline grooves are positioned in the exterior surface of the third tubular member and a second group of spline grooves are positioned the interior surface of the second tubular member, the first group of spline grooves and the second group of spline grooves being connected by a plurality of spline, thereby rotatably coupling the third tubular member with the second tubular member.

11. The shock tool as defined in claim 10, the spline being urethane coated, thereby providing dampening of torsional shock loading.

12. The shock tool as defined in claim 4, further comprising a reamer/stabilizer sleeve engaging the exterior surface of the second tubular member, the reamer/stabilizer sleeve having a raised profile.

* * * * *